US005577490A

United States Patent [19]

Overton, Jr.

[11] Patent Number: 5,577,490

[45] Date of Patent: Nov. 26, 1996

[54] EXHAUST HOOD FOR A PLURALITY OF DIVERSE HEATING OR COOKING DEVICES

[76] Inventor: Duncan E. Overton, Jr., 1016 Oglewood Ave., Knoxville, Tenn. 37917

[21] Appl. No.: 587,158

[22] Filed: Jan. 16, 1996

[51] Int. Cl.[6] ..... F24C 15/20

[52] U.S. Cl. ..... 126/299 D; 126/299 R; 55/DIG. 36

[58] Field of Search ..... 126/299 R, 299 D, 126/300, 301, 303, 21 R, 299 A; 454/49, 53, 67; 55/DIG. 36

[56] References Cited

U.S. PATENT DOCUMENTS

| | | | |
|---|---|---|---|
| Re. 22,228 | 12/1942 | Petersen | 126/299 |
| 253,499 | 2/1882 | Bean . | |
| 4,011,802 | 3/1977 | Molitor et al. | 98/115 K |
| 4,137,904 | 2/1979 | Dorius | 126/299 D |
| 4,738,244 | 4/1988 | Welsh | 126/299 R |
| 5,002,040 | 3/1991 | MacFarlane | 126/299 D |
| 5,205,279 | 4/1993 | Brown | 126/299 R |
| 5,320,088 | 6/1994 | Nester | 126/299 D |

*Primary Examiner*—James C. Yeung
*Attorney, Agent, or Firm*—Paul E. Hodges

[57] ABSTRACT

An exhaust hood for commercial or institutional kitchens. The hood is designed to capture individually each of the plumes emanating from diverse cooking or heating devices disposed beneath the hood and includes means for minimizing the quantity of air removed from the atmosphere ambient to, but outside the hood, this means including a plenum within the hood and individually sized entrance openings into compartments defined above each of the cooking or heating devices and through which ambient air is drawn at a minimum capture velocity for that plume anticipated to be generated by the heating or cooking device that is associated with each compartment. A method for carrying out the invention is disclosed.

9 Claims, 5 Drawing Sheets

EXHAUST HOOD FOR A PLURALITY OF DIVERSE HEATING OR COOKING DEVICES

FIELD OF INVENTION

This invention relates to commercial or institutional kitchen ventilation systems, and particularly to an exhaust hood of the non-makeup air type disposed over a plurality of diverse heating or cooking devices within a kitchen. "Diverse", as used herein includes diversity of heating capacity and/or diversity in profile of a heating or cooking device, as the context indicates.

BACKGROUND OF INVENTION

In a commercial or institutional kitchen there is a conflict between the need to maintain a comfortable environment for the kitchen personnel while withdrawing from the kitchen environment sufficient air to accommodate an exhaust hood which is designed to withdraw the plume rising from cooking or heating devices such as deep fat fryers, ovens, ranges, flame cookers, grills, and the like. These plumes may include heated air, particulates of water vapor and/or organic material released from the food being cooked or heated and entrained in the heated air that rises from the heating or cooking device, and/or fumes from combustion heating elements. The velocity of these plumes depends largely upon the surface temperature of the heating or cooking device and tends to vary from about 15 fpm over steam equipment to about 150 fpm over charcoal broilers, for example. These plumes, if undisturbed by extraneous air currents, will normally rise from the cooking or heating surface. Under these undisturbed conditions, the plume is readily captured by a canopy type exhaust hood and conveyed to a discharge location outside the kitchen. When the plume is subjected to extraneous air currents, such as those generated by HVAC equipment serving the kitchen, movement of personnel past the hood, etc., the flow of the plume is disturbed and tends to not be readily captured by the exhaust hood.

In the prior art, the actual quantity of air and flow velocity of the air to be used to capture and exhaust a plume is determined by the flow rate of the plume, plus a safety allowance to absorb cross-drafts, flare ups, etc., plus a safety factor for the style of hood. Gas-fired equipment may require an additional allowance for the intake of combustion air and exhaust of combustion products. In the prior art, it is known that the use of a single hood over a single heating or cooking device is impractical so that groups of devices should be disposed beneath a single hood, and that optimum efficiency of operation, hence cost, of a hood is achieved when the all the heating and cooking devices disposed beneath a single hood have the same profile, i.e. the devices should all have their heating or cooking surfaces at or near the same horizontal level. Tall ovens, for example, should not be disposed under the same hood as ranges, charbroiler, etc. wherever possible. First, the taller oven requires that the hood be located at a relatively high horizontal level which placed the hood inordinately far above the source of the plume from a charbroiler, for example. This, in turn, requires that the exhaust air flow rate for the hood be greater so as to ensure capture of the plume from the charbroiler (a low profile device). Obviously, the economics of this situation are not desirable.

In the prior art, the exhaust flow rate (cfm) of a hood is based upon, among other things, the type of hood, e.g. wall mounted canopy, backshelf, island canopy, etc., the equipment under the hood, the flow rate required for the hood being based on the flow rate required to exhaust the plume from that heating or cooking device which generates the greatest heat, and presumably the greatest plume. In any event, there must be sufficient volume of air entering the hood which will provide the required exhaust flow rate for the hood. Heretofore these requirements have been sought to be met by one of two methods. In a first method, a somewhat arbitrary exhaust air flow rated, in cfm, is chosen, based largely upon the type of equipment to be disposed beneath the hood, and this air flow rate is multiplied by the area, in $ft^2$, of the entrance opening to the hood. Using this method, a hood having an entrance opening of 26 $ft^2$ and which is to service a charbroiler and other low profile devices, the arbitrary number commonly is at least 200, thereby requiring an exhaust air flow rate for the hood of 5200 cfm. In a second method, a substantially larger, but still somewhat arbitrary air flow rate, in cfm, is chosen, again based largely upon the type of equipment to be disposed beneath the hood, and this value is multiplied by the linear feet of hood. For a 13 ft. long hood, servicing a charbroiler and other low profile devices, an arbitrary number of 300 is commonly chosen for this calculation. In this example, the hood should have an exhaust air flow rate of 3900 cfm.

Conventional teaching in kitchen ventilation holds that the exhaust flow rate should at least equal or exceed the plume flow rate. This ensures both that the total of the plume volume will be exhausted through the hood and that the velocity of the plume flow is sufficient to capture and retain therein the particulates associated with the plume. The only material consideration given in the prior art to such factors as the great diversity of type of heating or cooking devices that may be disposed beneath a given exhaust hood, the great diversity of plumes which may be generated by the devices, and the large number of environmental factors that may exist outside the hood, but within the kitchen environment, has been the inclusion of a safety factor in the calculation of the minimum exhaust hood air flow rate. As a consequence, the prior art hoods tend to be grossly oversized, hence costly to fabricate, install and operate. Further, in the prior art, as circumstances change following the initial design and installation of a hood, such as substitution of a different cooking device under the hood or other changes which affect the required capture velocity, the prior hoods have not possessed the capability to change the capture velocity of the air drawn into the hood, aside from changing the exhaust fan capacity of the hood. This latter action serves to exacerbate the over sizing of the hood.

Obviously, air exhausted by a hood of the non-makeup air type must come from the kitchen environment. The environment of the kitchen most commonly is "tempered", i.e. conditioned or heated, depending upon the season of the year, etc. Providing this tempered air is costly so that desirably only a minimum volume of this tempered air is exhausted by the operation of the exhaust hood.

Still further, its is conventional prior art teaching that canopy hoods should overhang the cooking or heating equipment serviced by the hood, often as much as 12 inches overhang in the front of the hood. This overhang requirement requires that the most lower front edge of the hood be at least about six and one-half feet above the floor to avoid kitchen personnel bumping into the hood with their head. This requirement places a further requirement on these prior art canopy hoods in that the distance between the cooking or heating surface of the equipment and the entrance to the hood becomes excessive and added exhaust flow capacity is required to prevent the plume from expanding and escaping from under the hood before it can be drawn into the hood.

It is an object of the present invention to provide an exhaust hood of the non-makeup air type for exhausting the plumes from a plurality of diverse heating or cooking devices disposed beneath the hood, and which minimizes the total volume of tempered air removed from the kitchen atmosphere ambient to and outside the hood.

It is another object of the present invention to provide an exhaust hood which cost-effectively ensures proper exhaust volume of the hood when servicing a plurality of diverse heating or cooking devices disposed there beneath.

It is another object of the present invention to provide an exhaust hood which has no forward overhang and may be set-back from the most forward edge of the heating or cooking equipment serviced by the hood.

It is another object of the present invention to provide an exhaust hood which is amenable to ready and easy physical alteration thereof in a manner that optimizes the capture velocity of air moving from the kitchen environment, over the heating or cooking devices, into a plenum defined within the hood, and thereafter exhausted externally of the hood and kitchen.

Other objects and advantages of the present invention will be recognized from the description contained herein, including the specification, claims and drawings, in which:

SUMMARY OF THE INVENTION

Figure 1:
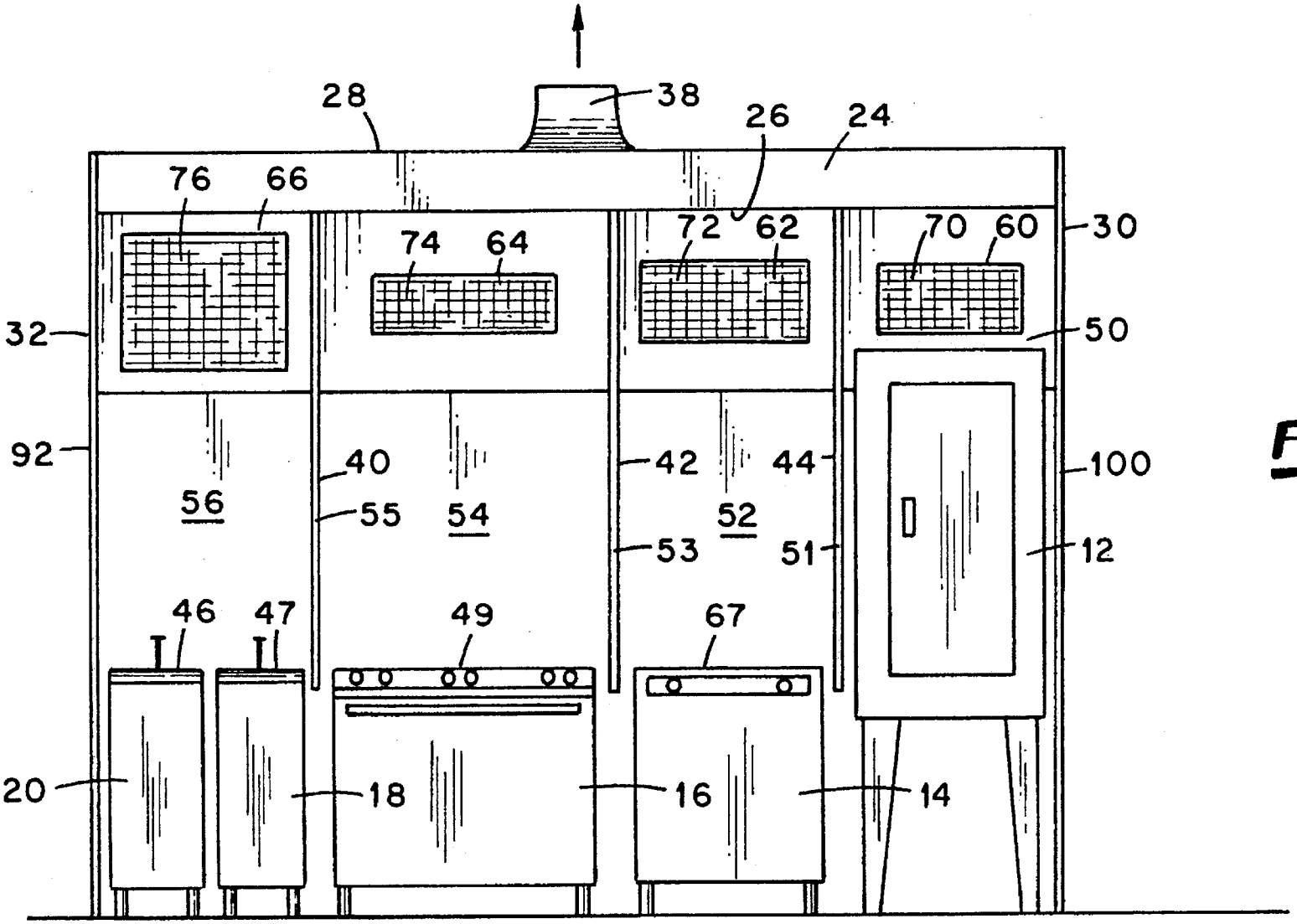
FIG. 1 is a diagrammatic front elevational view of an exhaust hood embodying various of the features of the present invention.

In accordance with the present invention there is provided an exhaust hood of the non-makeup air type suitable to service a plurality of diverse heating or cooking devices disposed there beneath. The present hood includes a plenum defined interiorly of the hood, and vertical partitions depending from the hood and between adjacent ones of the diverse heating or cooking devices to a terminal location adjacent the upper surface of the heating or cooking device. These partitions define a plurality of side-by-side partitioned compartments above individual one or ones of the diverse heating or cooking devices. Individual entrance openings to the plenum from each of the partitioned-off compartments above a heating or cooking device are provided, each such entrance opening being sized to establish an exhaust flow velocity through the entrance opening that develops a capture velocity of the air flow over the surface of the heating or cooking device, that equals or slightly exceeds that capture velocity dictated by the type of heating or cooking device disposed with the partitioned compartment. In addition to isolating the diverse heating or cooking devices into partitioned areas, the partitions further serve to minimize the effect of extraneous air currents upon the flow of air within each of the partitioned compartments. Selectivity of the capture velocity of the air flowing through the individual compartments is provided by means of readily and easily removable front wall panels which may be added or removed from each individual compartment to thereby increase or reduce the size of the entrance opening to the hood for each compartment. This feature of the hood permits the selection of that combination of entrance opening size and air flow into the hood from a compartment, as provides a capture velocity of the air flowing through the compartment that is unique for the particular heating or cooking device disposed within the particular compartment.

Employing the present invention, it has been found that the present hood can be provided with a maximum exhaust flow capacity equal to or slightly greater than that air flow which is required to establish the total of the selected capture velocities for all of the partitioned compartments. Thus, in the present hood, the capture velocity of each of the partitioned compartments is calculated, taking into consideration the nature of the plume anticipated to emanate from that heating or cooking device which is disposed within each compartment, and established by selecting a minimum size of the entrance opening of each compartment. The total of these calculated minimum capture velocities dictates the exhaust flow capacity of the hood, a value which is far less than the exhaust flow capacity taught in the prior art for the same hood and the same array of heating or cooking devices. By this means, the volume of air withdrawn from the kitchen atmosphere ambient to and outside the hood is minimized.

DETAILED DESCRIPTION OF THE INVENTION

With reference to the several Figures, in accordance with one aspect of the present invention, there is provided an exhaust hood 10, such a backshelf-type hood, that is disposed above and over a plurality of diverse heating or cooking devices such as a convection oven 12, a charbroiler 14, an open-top range 16 and two deep fat fryers 18 and 20. These heating or cooking devices are disposed in side-by-side relationship. Each is capable of generating a unique quantity of heat and each is capable of generating a diverse plume (not depicted) of heated air and entrained particulates therefrom which rises upwardly from the device and expands outwardly as it rises. The depicted two deep fat fryers may be of equal, or approximately equal, heat generating capacity, hence may emanate substantially identical plumes.

The depicted hood includes a rear wall 22, a front wall 24 having a substantially horizontal lower front edge 26, a top wall 28, end walls 30 and 32, and a bottom wall 34, these walls defining a plenum 36 internally of the hood. In the depicted embodiment, the bottom wall 34 is inclined inwardly and upwardly from the rear wall 22 so as to be in the path of the plumes rising from the heating or cooking devices that are disposed beneath the hood. An exhaust port 38 is provided in the top wall. An exhaust fan (not shown) is connected in fluid flow relationship to the exhaust port for drawing air from the plenum through the exhaust port and out of the hood to a discharge location. Notably, the vertical plane occupied by the front wall 24 is set back by about twelve inches from the vertical plane occupied by the fronts 31, 33, 35, 37 and 39 of the heating or cooking devices disposed beneath the hood.

A plurality of vertical planar partitions 40, 42, and 44 depend from the bottom wall 34 to respective terminal locations 41, 43, and 45, adjacent, and preferably slightly below, the horizontal level of the respective upper surfaces 46, 47, 49, and 67 of the deep fat fryers, the open-top range and the charbroiler. Each partition further extends generally perpendicularly to and outward from the rear wall 32. Specifically, a first partition 44 is disposed between the oven 12 and the charbroiler 14. This first partition 44 and the end wall 30 define therebetween a first partitioned compartment 50 immediately above the oven 12. A second partition 42 is disposed between the charbroiler 14 and the open-top range 16 to define a second partitioned compartment 52 immediately above the charbroiler 14. A third partition 40 is disposed between the open-top range 16 and the deep-fat fryer 18 to define a third partitioned compartment 54 immediately above the open-top range 16. In the depicted embodiment, the end wall and the third partition 40 define a fourth partitioned compartment 56 immediately above the two deep fat fryers 18 and 20. Each of the partitioned compartments is disposed beneath the hood such that the front edges 51, 53, and 55 of the partitions occupy the same vertical plane as does the vertical front wall 24 of the hood so that these front edges are also set back by as much as twelve inches, for example, from the fronts of the heating or cooking devices. Lesser setbacks may be employed, but the setback should not be so small, in inches, as to interfere with movements of a cook. Greater setbacks tend to prevent the compartmentalization of the plume from a given piece of heating or cooking equipment so that one loses the benefit of the compartments in isolating the individual plumes from the several pieces of heating or cooking devices, as has been discovered by the present inventor. This combination of features permits the existence of the partitions without undue interference with the normal movements of a cook when using the heating or cooking devices, including both lateral movements and head clearance. Each compartment includes an entrance opening into the hood which is bounded by the lower front edge of the hood, the front edges of the partitions which separate the compartments, the end wall (where applicable), and the top surfaces of the devices(s) disposed within a respective compartment. More specifically, in the depicted embodiment of the present invention, the entrance opening 89 to the compartment 56 bordered by a portion 90 of the horizontal lower front edge 26 of the front wall 24 of the hood, the front vertical edge 92 of the end wall 32, the front vertical edge 55 of the partition 40, and the horizontal upper surfaces 46 and 47 of the deep fat fryers 18 and 20 that are disposed within the compartment. The entrance opening 93 of the compartment 54 is bordered by a further portion 94 of the horizontal lower front edge 26 of the front wall 24 of the hood, the vertical front edges 55 and 53 of the partitions 40 and 42, and the horizontal upper surface 49 of the open-top range 16. The entrance opening 94 of the compartment 52 is bordered by a further portion 95 of the horizontal lower front edge 26 of the front wall 24 of the hood, the vertical front edges 53 and 51 of the partitions 42 and 44, and the horizontal upper surface 67 of the charbroiler 14. Still further, the entrance opening 96 to the compartment 50 is bordered by a further portion 98 of the horizontal lower front edge 26 of the front wall 24 of the hood, the vertical front edge 100 of the end wall 30, the vertical front edge 51 of the partition 44, and the horizontal upper surface 102 of the oven 12.

Figure 4:
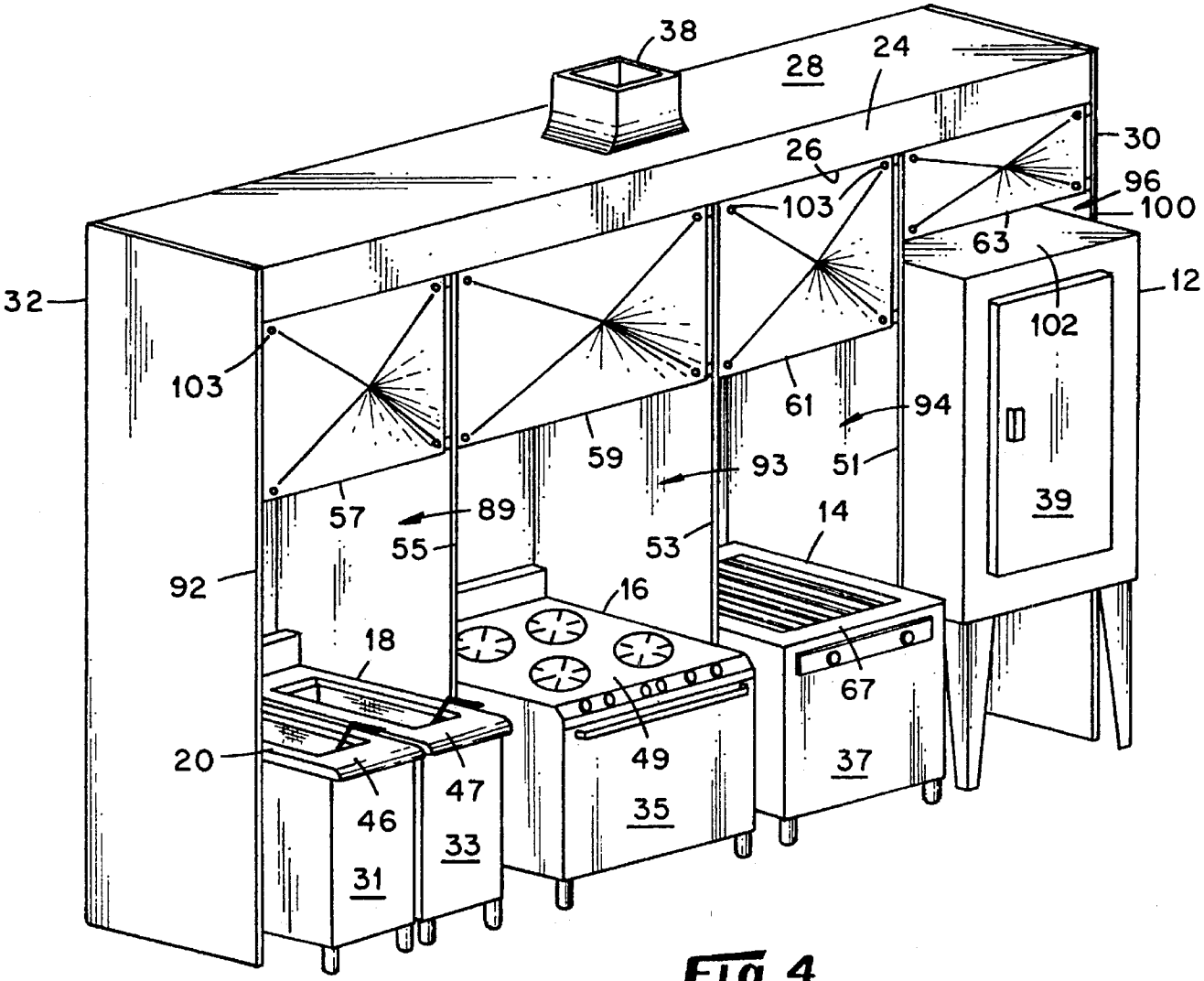
FIG. 4 is a perspective view of the exhaust hood of FIG. 3 and showing panels associated with each of the compartments of the present hood.

Referring to FIG. 4 specifically, the present hood is provided with a plurality of removable front panels 57, 59, 61 and 63, each of which is designed to be mounted vertically adjacent and substantially coplanar with the lower front edge 26 of the front wall 24 of the hood, which is coplanar with the front edges of the partitions 51, 53, and 55 and the front edges 92 and 100 of the end walls 30 and 32, and between respective ones of the end walls 30 and 32 and the partitions 40, 42, and 44 to reduce the area bordered by the lower front edge of the hood, the end walls, the partitions and the upper surfaces of the cooking or heating devices, hence selectively reduce the area of the individual entrance openings into the hood. More specifically, each of the partitions is provided with a plurality of brackets 65 (typical) anchored thereto adjacent the front vertical edges 51, 53, and 55 of the partitions and adjacent to the vertical front edges 92 and 100 of the end walls. A first panel 57 is removably secured to the end wall 32 and to the partition 40 as by means of screws 103 (typical), or other suitable removable fasteners, to provide an upper front closure of a portion of the area bounded by the lower front edge 26 of the front wall 24 of the hood, the front edge 92 of the end wall 32, the front edge 55 of the partition 40 and the upper surfaces 46 and 47 of the deep fat fryers 18 and 20. By this means, the entrance opening into the partitioned compartment 56 may be selectively reduced, depending upon how far the panel 57 extends downwardly from the lower front edge of the hood. The further panels 59, 61 and 63 are similarly mounted to cover and close off a portion of the upper area of the entrance opening for each of the further compartments 50, 52 and 54 to preclude the flow of air through that closed portion of each entrance opening. In the embodiment depicted in FIG. 4, the panel 63 disposed above the convection oven 12 disposed in compartment 50, is notably smaller in area that either of the panels which are disposed above the others of the heating or cooking devices within the compartments 52, 54 and 56, thereby depicting the ability of the present invention to provide selectivity in the choice of the area of the entrance openings to each of the several compartments. Accordingly, each entrance opening may be selected to be of a size which is specific for developing the desired unique flow velocity of air therethrough which will ensure capture of the plume emanating from the heating or cooking device(s) which is disposed within the specific partitioned compartment. Further, it is to be noted that through the use of the panels for closing off a selected portion of the area of an entrance opening, there is provided a means for accommodating, under a single hood, a diversity of heating or cooking devices of different vertical heights. This capability further permits adaptation of the size of a particular entrance opening to the capture velocity of air flow through a compartment to be chosen to match the capture velocity required for the plume which is generated by a given piece of heating or cooking equipment that might be associated with a given compartment of the hood. That is, the size of the opening associated with each partitioned compartment, may be chosen to permit the velocity of air flow therethrough and into the plenum, which is minimum for the anticipated plume emanating from that heating or cooking device(s) which is associated with the particular partitioned compartment. This arrangement provides for minimization of the volume of air required to be withdrawn from the kitchen atmosphere ambient to and outside the hood, hence minimization of the cost of operation of the hood (e.g. power to operate the exhaust fan) and minimization of the adverse effect of the hood exhaust upon the tempered atmosphere within the kitchen.

Further, the present inventor has found that by isolating the plume from a given one (or ones) of the heating or cooking devices disposed beneath the hood to a partitioned compartment, one can effectively eliminate the adverse dispersing effect on a plume by relatively minor air flow currents extraneous to the hood, can effectively neutralize the adverse dispersing effect of even relatively major air flow currents extraneous to the hood, and, through the use of selected panels to limit the area of the entrance opening for the flow of air into and through each compartment, can selectively adjust the air flow into and through a compartment, thereby selectively adjusting the capture velocity of this air flow. This concept permits a relatively precise selection of that minimum flow velocity of air through each partitioned compartment which will ensure capture of the plume emanating from the particular heating or cooking device(s) which is associated with a particular partitioned compartment. In the present invention, the forward extent of the partitions also effectively eliminates any cross-over of plumes between compartments, thereby further isolating the individual plume from a given piece of heating or cooking equipment to a single compartment. Still further, the provision of removable panels of selected size (area) for closing off a portion of the entrance opening into each compartment provides for the accommodation by the hood of both high profile heating or cooking devices, such as a convention oven, and for low profile devices such as ranges, charbroilers, etc.

Within the bottom wall 34 of the hood there are defined a plurality of openings 60, 62, 64, and 66 therethrough which provide for fluid flow from the compartments 50, 52, 54, and 56, through the bottom wall, and into the common plenum 36, thence out through the exhaust port 38. Each of openings 60, 62, 64, and 66 is associated with only one of the partitioned compartments 50, 52, 54, and 56, respectively.

Figure 2:
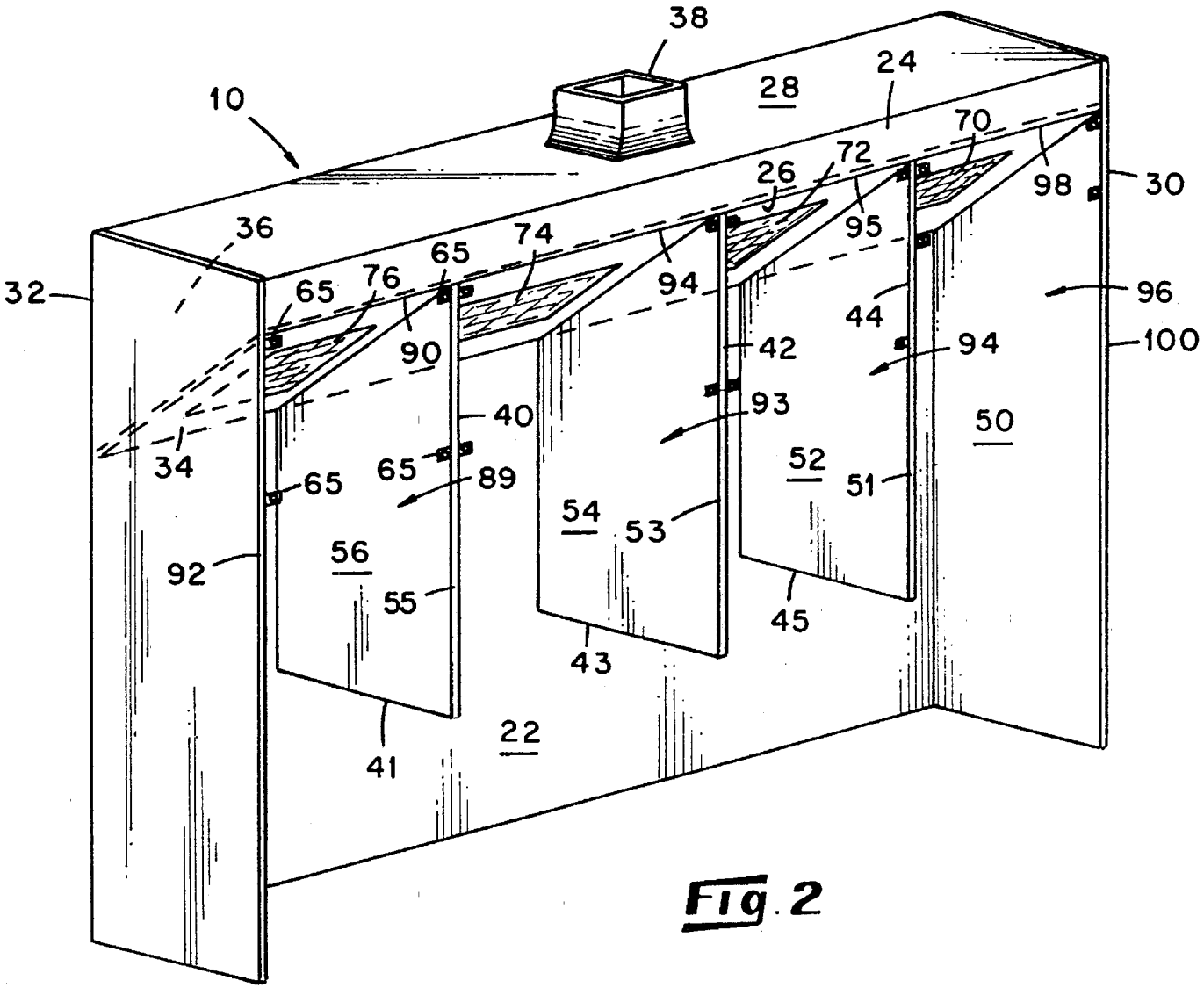
FIG. 2, is a perspective view of an exhaust hood depicting various of the features the present invention, but without depicting heating or cooking devices associated therewith.
Figure 3:
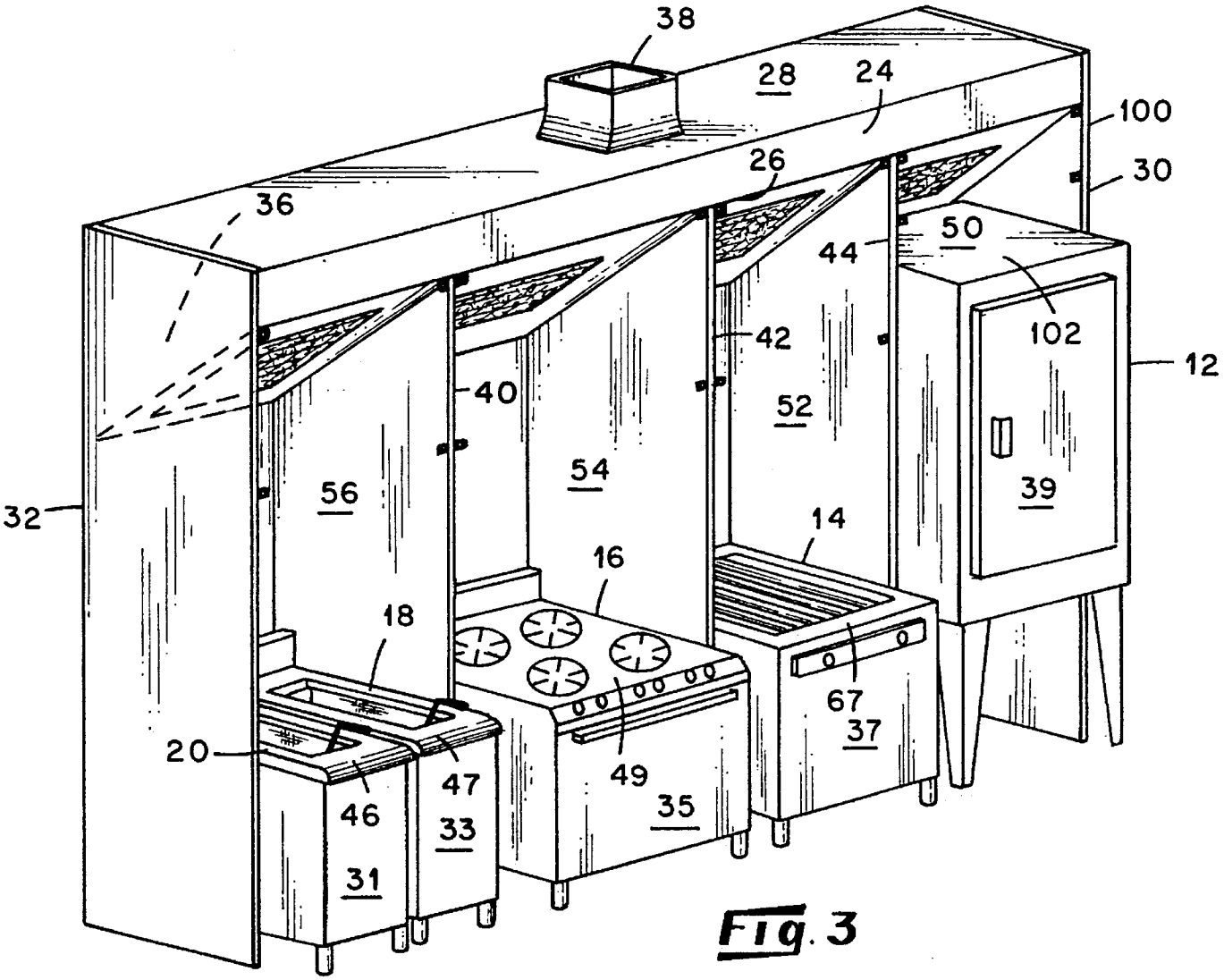
FIG. 3 is a perspective view of an exhaust hood as in FIG. 2, and depicting a diversity of heating or cooking devices associated with the hood.
Figure 5:
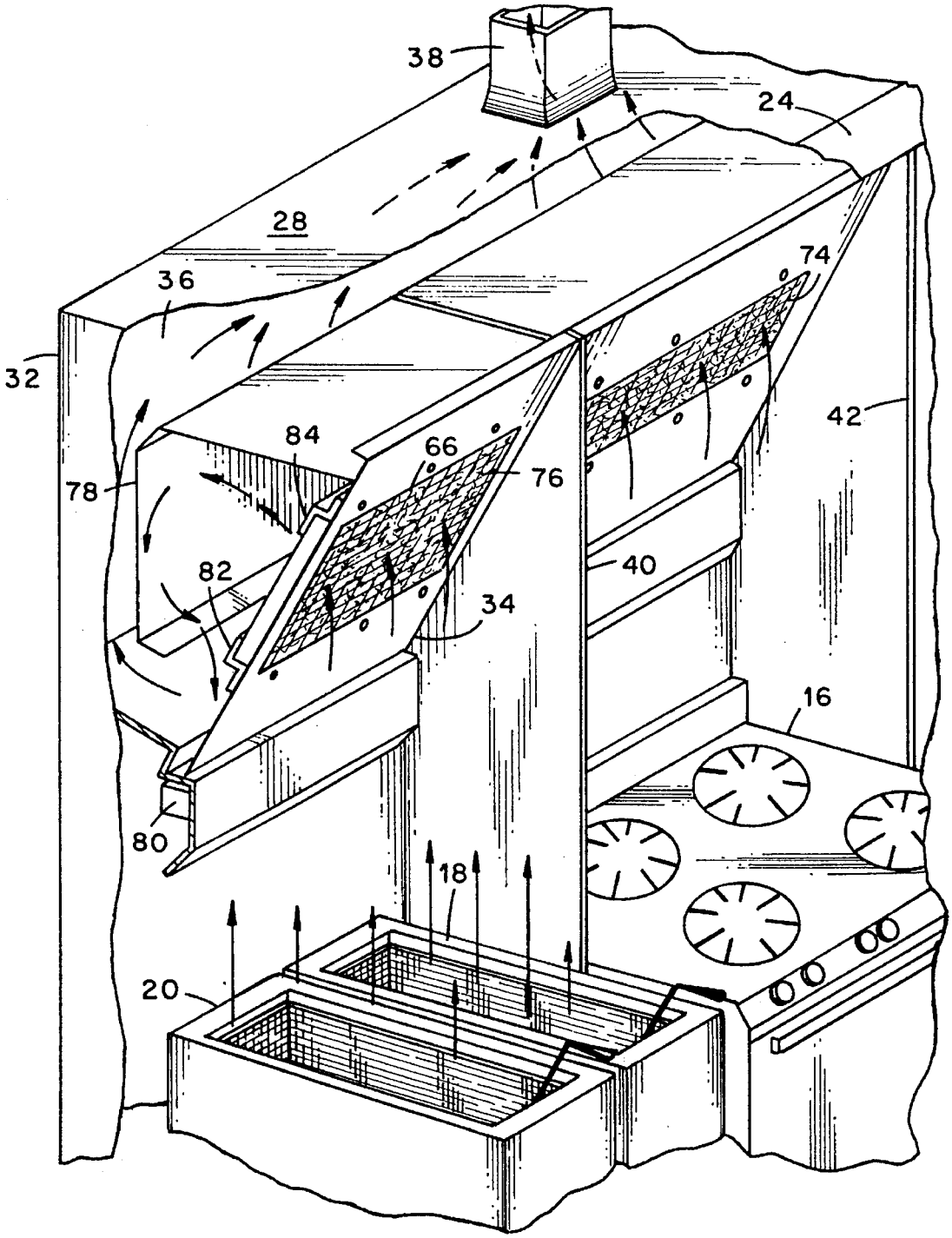
FIG. 5, is a perspective view of a portion of an exhaust hood of the type depicted in FIG. 3 and partially cutaway to show various of the features of the present invention.

As depicted in FIGS. 2 and 3, each of the openings 60, 62, 64, and 66 is provided with a grease filter 70, 72, 74, and 76, respectively, which fully covers the opening. Each filter is of a commercially available design well known in the art and is constructed so as to entrap grease (and/or other particulates) from the plume which passes through each of the openings. As desired, each opening may also be provided with one or more baffles, such as baffle 78 associated with opening 66, for example, which redirects the flow of air entering the plenum 36 to cause grease particulates to impinge thereupon, and/or impinge upon one of more of the walls of the plenum, to cause the grease particulates to fall out of the air flow and be drop into a grease collector 80 for subsequent removal therefrom. In accordance with one aspect of the present invention, each of these filters may be selected to be of a size which permits more or less air to flow out of a given compartment and into the plenum 36. FIG. 5 depicts one embodiment of a grease filter 76 and a set of brackets 82 and 84 which may be secured to bottom wall 34 of the hood in positions suitable for the receipt of the filter 76 therein. Through the selection of the size of each filter, further control over the flow of air through the hood is provided for. As will be recognized by one skilled in the art, each of the filters may be of the adjustable permeability type, the permeability of each filter being selected to permit that flow of air therethrough which is optimum for a given compartment.

Referring specifically to FIG. 1 in a specific embodiment of an exhaust hood of the non-makeup air type as contemplated by the present invention for use in the collection of the plumes from a combination of heating or cooking devices that includes a convection oven 12, a charbroiler 14, an open-top range 16, and two deep fat fryers 18 and 20 disposed in side-by-side relationship beneath a hood of 14 feet length, one prior art mode for calculating the exhaust air flow rate from the exhaust port of the hood would be to multiply the maximum anticipated air flow (in cfm) for the hottest device disposed beneath the hood,(for example, 200 cfm for a charbroiler) by the area of the entrance opening to the hood (for example, 2 ft. times 13 ft.=28 $ft_2$). This calculation would predict a minimum exhaust flow rate of 5200 cfm.

In accordance with the concepts of the present invention, it is now possible to calculate the minimum exhaust air flow rate for the hood by adjusting the air flow rate in each compartment to achieve a preselected minimum capture velocity (for example, a capture velocity between about 15 fpm (steamer) and about 150 fpm (charbroiler) for the plume generated in each compartment. These individual air flow rates are then totaled to give the minimum exhaust air flow rate for the hood. By way of example, if in the depicted hood there is included two deep fat fryers (medium heat capacity), an open-top range (medium heat capacity), a charbroiler (high heat capacity) and a convention oven (low heat capacity), one can select that size of entrance opening which will produce a capture velocity equal to the anticipated capture velocity for each of the devices in each compartment, and then convert this capture velocity in fpm to cfm air flow rate. The total of the air flow rates for the several compartments then is chosen as the minimum exhaust air flow rate for the hood. Assuming a capture velocity for the two deep fat fryers of 65 fpm, for the open-top range of 65 fpm, for the charbroiler of 150 cfm, and for the convection oven of 15 cfm, and assuming the width of compartments 50, 52, 54, and 56, to be 3 ft., 4 ft., 3 ft., and 3 ft., respectively, and the height of the lower edge of the panels above the top surfaces of the devices within compartments 52, 54, and 56 to be 2 ft., and within compartment 50 to be 0.5 ft., one can calculate that the minimum exhaust air flow rate, in cfm, for the hood to be 120 cfm for compartment 50, 390 cfm for compartment 52, 520 cfm for compartment 54 and 390 cfm for compartment 56, for a total of 1420 cfm as the minimum exhaust air flow rate for the hood. This is to be compared with a minimum exhaust air flow rate of greater than about 3900 to 5200 cfm as taught in the prior art.

Whereas specific embodiments of the features of the present invention have been presented and described, it is intended that the invention be limited only by the claims appended hereto.

What is claimed:

1. An exhaust hood for capturing individually each of the plumes emanating from a plurality of diverse heating or cooking devices disposed beneath the hood while minimizing the quantity of air removed from the atmosphere ambient to and outside the hood comprising housing means defining an elongated hood adapted to be mounted generally horizontally and above and in substantially covering relationship to a plurality of diverse heating or cooking devices, said hood including a substantially vertical rear wall, a substantially vertical forward wall having a substantially horizontal lower front edge, a top wall joining said rear wall to said forward wall, and a bottom wall joining said lower front edge of said front wall to said rear wall, and end walls, each of which includes a front edge, said walls defining a plenum internally of said hood and which extends substantially along the horizontal dimension of said hood and between said end walls, at least one vertical partition means depending from said bottom wall of said hood and having a lowermost edge and front and rear edges, said rear edges of said partitiion being disposed adjacent said rear wall, said partition projecting forwardly from and substantially perpendicular to said rear wall and disposed between respective ones of said diverse heating or cooking devices, said vertical partition means terminating at its lowermost edge adjacent to or slightly below the horizontal level of the upper surface of adjacent ones of said heating or cooking devices, and dividing the volume between the rear wall, the bottom wall of the hood and the heating surfaces of the heating or cooking devices into individual compartments, each of said compartments containing a heating or cooking device, and having an open front which is bordered by a portion of the lower front edge of said front wall, the front edges of adjacent partitions or of the front edge of one partition and the front edge of an end wall, and the upper surface of a heating or cooking device that is disposed within said compartment and defining an entrance opening into said hood for the flow of air from the atmosphere ambient to said hood into said compartment, filter means interposed between each of said compartments and said plenum, panel means for removable mounting in partial covering relationship to said open front of each of said compartments, and exhaust means adapted to exhaust air from said plenum to a location outside said hood.

2. The exhaust hood of claim 1 wherein the horizontal dimension of each compartment is substantially equal to the width of that heating or cooking device which is associated with said each compartment.

3. The exhaust hood of claim 1 wherein the size of each panel means associated with a given compartment is selected as a function of the desired capture velocity of air flow into and through the given compartment whereby the area of of each entrance opening of each compartment is limited to that area which will develop a minimum capture velocity of the air flow through said compartment for the anticipated plume to be generated by that heating or cooking device which is associated with said compartment.

4. The exhaust hood of claim 1 wherein the air flow rate of the air exhausted by said exhaust means represents a total of all the minimum air flows through the several compartments of said hood and into said plenum.

5. A method for the capture and exhausting of a plurality of diverse plumes emanating from a plurality of diverse heating or cooking devices disposed beneath an exhaust hood comprising the steps of providing an elongated hood of the non-makeup air type above and in the path of the diverse plumes are they rise naturally from their respective heating or cooking device, defining a plenum internally within the hood and extending along substantially the full length of the hood, providing exhaust means for withdrawing air from said plenum and discharging the same externally of said hood, dividing the hood into a plurality of individual partitioned compartments, said partitioned compartments effectively isolating individual ones of the heating or cooking devices within respective ones of said partitioned compartments, providing individual through openings leading in fluid flow communication from the atmosphere external to said hood and into respective ones of said partitioned compartments, selecting a size for each of said through openings leading into said individual compartments, each of which provides for the air flow velocity therethrough as a result of the withdrawal of air from said plenum by said exhaust means to equal or slightly exceed the capture velocity of the maximum plume emanating from the heating or cooking device associated with that partitioned compartment, providing individual through openings leading in fluid flow communication from said individual partitioned compartments into said plenum, establishing the air flow rate of said exhaust means to a value which is equal to or slightly greater than the total of the individual capture velocities for the several partitioned compartments.

6. The method of claim 5, and including the step of orienting the individual openings leading into said compartments within a substantially vertical common plane.

7. The method of claim 6 and including the step of disposing said substantially vertical common plane occupied by said individual openings at a horizontal location that is set back from the most forward face of the individual heating or cooking devices disposed beneath said hood.

8. The method of claim 7 and including the step of selecting said set back of said individual openings at a value of not greater than about twelve inches.

9. The method of claim 5 wherein said hood includes one or more panels adapted to be removable secured over a portion of one or more of said compartments, and including the step of disposing one or more of the panels over one or more of said entrance openings to thereby reduce the open area of said entrance openings.

* * * * *